US010004280B2

(12) United States Patent
Farron et al.

(10) Patent No.: US 10,004,280 B2
(45) Date of Patent: Jun. 26, 2018

(54) FREEDOM OF MOVEMENT JACKET/COAT

(71) Applicant: NIKE, Inc., Beaverton, OR (US)

(72) Inventors: Daniel Farron, Ameterdam (NL); Sheilah A. Van Sisseren, Portland, OR (US); Lindsey V. J. Martin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 170 days.

(21) Appl. No.: 13/673,260

(22) Filed: Nov. 9, 2012

(65) Prior Publication Data

US 2014/0130232 A1 May 15, 2014

(51) Int. Cl.

| | |
|---|---|
| ***A41D 3/02*** | (2006.01) |
| ***A41D 1/02*** | (2006.01) |
| ***A41D 27/10*** | (2006.01) |
| ***A41D 15/00*** | (2006.01) |
| *A41D 3/00* | (2006.01) |

(52) U.S. Cl.

CPC ..... *A41D 1/02* (2013.01); *A41D 3/02* (2013.01); *A41D 15/007* (2013.01); *A41D 27/10* (2013.01); *A41D 3/00* (2013.01)

(58) Field of Classification Search

CPC ... A43D 1/02; A43D 1/04; A43D 3/02; A43D 3/04; A43D 15/00; A43D 31/02

USPC ..... 2/85, 86, 88, 89, 91, 92, 94, 96, 95, 93, 2/97, 102, 103, 104, 106, 113, 114, 125, 2/309, 913

See application file for complete search history.

(56) References Cited

U.S. PATENT DOCUMENTS 1,190,504 A * 7/1916 Bernstein ..... 2/127
1,361,892 A * 12/1920 Naterman ..... 2/94
2,159,408 A * 5/1939 Siegel ..... A41D 27/10 2/93

(Continued)

FOREIGN PATENT DOCUMENTS

CN 2232210 Y 8/1996
CN 101584501 A 11/2009

(Continued)

OTHER PUBLICATIONS

Notification of Transmittal of the International Search Report and the Written Opinion of the International Searching Authority, dated Apr. 14, 2014, International Application No. PCT/US2013/069246, 13 pages.

(Continued)

*Primary Examiner* — Katharine Gracz

(74) *Attorney, Agent, or Firm* — Shook, Hardy and Bacon L.L.P.

(57) ABSTRACT

The present invention relates to a jacket/coat designed to provide an enhanced range of motion and airflow between the inside and outside of the jacket. This is accomplished by having a layered construction comprising different fabric/textile materials where the enhanced range of motion and airflow are desired. The jacket/coat in accordance with the present invention particularly provides an enhanced range of motion for a wearer around the shoulders and arms. This enhanced range of motion may be especially beneficial when the wearer is engaged in a physically demanding activity or any activity benefiting from a wide range of movement by the wearer's arms and shoulders.

9 Claims, 9 Drawing Sheets

(56) References Cited

U.S. PATENT DOCUMENTS

| | | | | | |
|---|---|---|---|---|---|
| 2,177,543 | A * | 10/1939 | Vecchi | A41B 9/06 | 2/113 |
| RE21,676 | E | 12/1940 | Shane | | |
| 2,270,435 | A * | 1/1942 | Hansen | A41D 27/10 | 2/115 |
| 2,514,276 | A * | 7/1950 | Berman | A41D 27/10 | 2/125 |
| 2,614,258 | A * | 10/1952 | Breier | A41D 1/02 | 2/93 |
| 2,707,786 | A * | 5/1955 | Stoner | 2/119 | |
| 3,049,719 | A * | 8/1962 | Carmen | A41D 27/10 | 2/108 |
| 4,320,538 | A | 3/1982 | Saft | | |
| 4,864,656 | A * | 9/1989 | Nesse | 2/97 | |
| 4,937,884 | A * | 7/1990 | Sherman | 2/129 | |
| 4,999,850 | A * | 3/1991 | Grilliot | A41D 13/00 | 2/126 |
| 5,687,423 | A * | 11/1997 | Ross | A41D 27/28 | 2/70 |
| 6,053,852 | A * | 4/2000 | Wilkinson | A41D 13/0015 | 2/69 |
| 6,895,597 | B1 * | 5/2005 | Rakic | A41D 27/10 | 2/115 |
| 7,117,539 | B1 | 10/2006 | Baacke | | |
| 7,343,629 | B2 * | 3/2008 | Hunt | 2/93 | |
| 7,578,005 | B2 * | 8/2009 | Vereen | A41B 1/00 | 2/108 |
| 7,636,948 | B1 * | 12/2009 | Crye et al. | 2/2.5 | |
| 7,770,234 | B2 * | 8/2010 | Roux et al. | 2/69 | |
| 7,966,668 | B2 * | 6/2011 | Bay | 2/93 | |
| 8,209,773 | B2 * | 7/2012 | Bothwell | A41D 13/1245 | 2/104 |
| 2008/0005825 | A1 * | 1/2008 | Tronvold | 2/95 | |
| 2009/0070914 | A1 * | 3/2009 | Landeck et al. | 2/95 | |
| 2009/0247046 | A1 * | 10/2009 | Fine | 450/30 | |
| 2010/0031415 | A1 | 2/2010 | Shadid | | |
| 2010/0186136 | A1 * | 7/2010 | Blauer et al. | 2/81 | |
| 2010/0199403 | A1 | 8/2010 | Greenblat | | |
| 2010/0203803 | A1 * | 8/2010 | Murphy et al. | 450/28 | |
| 2014/0130232 | A1 | 5/2014 | Farron et al. | | |

FOREIGN PATENT DOCUMENTS

| | | | |
|---|---|---|---|
| CN | 102669843 | A | 9/2012 |
| CN | 202425666 | U | 9/2012 |
| JP | S4217929 | Y1 | 10/1967 |
| JP | S6296202 | A | 5/1987 |
| JP | 2002339120 | A | 11/2002 |
| JP | 3167570 | U | 4/2011 |

OTHER PUBLICATIONS

International Preliminary Report on Patentability dated May 21, 2015 in Application No. PCT/US2013/069246, 7 pages.

European Search Report dated Sep. 29, 2016 in European Patent Application No. 13853319.5, 9 pages.

European Search Report dated Jun. 1, 2016 in European Patent Application No. 13853319.5, 6 pages.

European Office Action dated Jul. 12, 2017 in European Patent Application No. 13853319.5, 4 pages.

International Search Report with Written Opinion dated Nov. 29, 2016 in International Application No. PCT/US2016/050991, 8 pages.

* cited by examiner

FREEDOM OF MOVEMENT JACKET/COAT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to jackets and/or coats with enhanced range of motion. The present invention offers several practical applications in the technical arts, not limited to athletic wear, casual wear, etc. More particularly, the present invention relates to outer wear apparel that affords freedom of movement around the shoulders and arms of a wearer, especially when engaged in a physically demanding activity or any activity benefiting from a wide range of movement by the wearer's arms and shoulders.

BACKGROUND OF THE INVENTION

Weather often requires a person wear extra layers of clothing when outdoors. The extra layers of clothing may be constrictive, especially when engaging in an athletic activity, or any other type of physical activity. For example, golf is a sport that requires considerable range of motion in order to properly swing a club, but precipitation or cold weather may require extra clothing that can reduce the range of motion needed. A jacket/coat is a popular layering garment because it is versatile and usually has a loose fit, has a closable opening so it can be easily worn or taken off, and is usually made of a material that provides protection from environmental elements such as rain, wind, snow, temperature fluctuations, etc. The downside of using materials such as leather, or synthetic fabrics treated with materials to make them water repellent and/or wind repellent, may be that these materials may not have enough stretchability and/or breathability, or if they do have stretchability and/or breathability, the stretchability and/or breathability may be minimal. Such limited stretchability may render a garment impractical for activities requiring a higher degree of flexibility than is compatible with the garment. Further, for a sport such as golf, the potential fabrics to use for such a jacket may be limited by considerations such as the desire to limit the noise made by a garment during movement.

BRIEF SUMMARY OF THE INVENTION

An object of the present invention is to provide a comfortable jacket/coat that is protective from environmental elements such as rain, wind, etc. The jacket/coat in accordance with the present invention may have a layered construction, where different types of fabrics and or materials may be used in the different layers of the jacket/coat to achieve a comfortable wear for the wearer, without sacrificing the level of protection offered by the jacket/coat.

In a first example, the jacket/coat may comprise a first partial shrug-like portion (without the front pieces covering the chest) with a core, and with sleeves attached to the core. The sleeves may be long sleeves, short sleeves, three-quarter sleeves, or any other length desired for the particular style and use for the jacket. The first partial shrug-like portion may be constructed from an elastic and/or partially elastic type of material. The partial shrug-like portion and the sleeves may be made from a continuous piece of material, or the sleeved may be sewn onto the partial shrug-like portion at a given position below the shoulders to avoid having shoulder seams that may cause strain.

The partial shrug-like portion may optionally have a strain-relieving cutout on its back portion. The cutout may be triangular, for example, and may optionally have an elastic stabilizer to stabilize the cutout. For example, the cutout may be downwards pointing triangular shape with a stabilizing elastic band across the wide end of the triangle closer to the collar of the jacket/coat.

Further, the jacket/coat may comprise a vest portion that is longer than the partial shrug-like portion, layered on top of the partial shrug-like portion. The partial shrug-like portion may then be attached to the vest portion at a seam located at the bottom edge of the shrug-like portion, at the collar seam of the partial shrug-like portion and the vest portion, and at a front edge of each armhole to the corresponding front area of each respective sleeve, in other words, there may be no seams attaching the partial shrug-like portion and the vest portion on the back side of the jacket so that the sleeves may essentially be free-floating so that when a wearer may need to stretch his/her back pulling his/her arms forward or in any other direction, this motion may be performed freely.

The vest portion may be constructed from the same material as the partial shrug-like portion, or alternatively, may be constructed from a different material, which may be elastic and/or stretchable. A stretchable material may be a four-way stretchable textile, a two-way stretchable textile, a composite material, a sheet-type material, etc. Both the partial shrug-like portion and the vest portion may water-resistant or waterproof either inherently or due to a waterproofing treatment. Alternatively, an elastic and waterproof layer of a polymer material may be applied to the inner face of the material prior to making the jacket/coat, if waterproofing is desired.

Conceivably, in the case of rain or other environmental precipitation, or other water source, water could potentially enter through the gap on the back created where the sleeves are free-floating, and may accumulate in between the partial shrug-like portion and the vest portion. Therefore, the jacket/coat in accordance with the present invention may be provided with a plurality of perforations on the vest portion, slightly above the bottom edge seam between the partial shrug-like portion and the vest portion to allow the water to drain out without actually accumulating. Further, the bottom-edge of the partial shrug-like portion forming the seam, instead of being completely horizontal, may be slightly angled to guide any water present towards the plurality of perforations more efficiently in the water draining process. Depending on where the plurality of perforations is to be placed, the seam angle may be adjusted accordingly, for aesthetic and/or functional reasons. For example, if the perforations are in the middle of the back of the jacket/coat, the seam may form a slight semi-circular, or slight flat "V" shape angled just enough to guide the water toward the center, where gravity may work to pull the water down and be drained out of the jacket. The "V" shape may be maintained with a strap, a mesh insert, rigid or semi-rigid edges, etc., if such a structure is used.

In a different example of the jacket/coat in accordance with the present invention, the jacket/coat may comprise a shrug-like portion made out of a strong and flexible mesh-type material, or any other desired breathable material. The material forming the shrug-like portion may be made from synthetic and/or natural fibers, and additionally, may contain elastic fibers to add elasticity to the material. The sleeves of the jacket/coat may be attached to the shrug-like portion at the armholes of the shrug-like portion. The sleeves may be of any length desired for the jacket/coat, such as short, three-quarter, long, etc., and may be pieced together from different types of materials with differing properties such as elasticity, resiliency, etc.

The jacket/coat may further comprise a stiffer and longer vest portion over the shrug-like portion. The shrug-like portion may be free-floating inside the vest portion except for the seams at the collar, the bottom edge, and the front edges of the shrug-like portion. Since in this jacket/coat construction, the sleeves are free-floating from the stiffer vest portion at the shoulders, this construction may provide ventilation as well as enhanced range of motion, particularly when a wearer pulls his/her arms forward, or when a wearer lifts his/her arms above the shoulders.

Yet, in a different example of the jacket/coat in accordance with the present invention, a thick winter jacket/coat may be provided. Since winter jackets tend to be bulky for insulating purposes, inevitably, they may have limited breathability and may be restrictive and not allow a user full range of motion. Therefore, in the jacket/coat in accordance with the present invention, a composite sleeve may be provided, which may provide breathability and/or enhanced range of motion without compromising insulation from cold weather. In other words, the sleeve may comprise three different sections: a lower sleeve, an upper sleeve and a cover sleeve. The lower sleeve may be constructed in the same way and with the same materials as the rest of the jacket/coat including the insulating fibers, and may cover an arm anywhere from the wrist up to the elbow. Then, the upper sleeve comprising a flexible and resilient mesh-type, or any other breathable type of material, may be attached to the lower sleeve by a seam, and may cover the arm up to the shoulder and be attached to the jacket/coat at the seam around the armhole. Finally, the cover sleeve may also be constructed from the same materials as the rest of the jacket/coat, including the insulating fibers, and may be attached to the jacket/coat by a seam connecting it to the armhole of the jacket, just as the upper sleeve. The cover sleeve may extend from the shoulder to slightly below the upper sleeve in order to completely conceal the upper sleeve when the arms of a wearer are in a rest position parallel to the wearer's body. It may be noted that the length ratios of the upper and lower sleeves may be other than the one described above, and the length of the cover sleeve may also change accordingly.

The jacket/coat with the composite sleeve in accordance with the present invention, may allow for improved airflow between the inside and outside of the jacket/coat and may provide enhanced flexibility for a user due to the flexibility provided by the upper sleeve material, keeping the wearer more comfortable. In other words, the composite sleeve construction in accordance with the present invention may provide enhanced temperature regulation, as well as an enhanced range of motion for the user, by stretching (lengthening) the sleeve as required by the motions performed by the wearer.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The present invention is described in detail below with reference to the attached drawing figures, wherein.

DETAILED DESCRIPTION OF THE INVENTION

The present invention provides a jacket/coat with enhanced range of motion around the shoulders and the arms. In addition to enhanced range of motion, an additional advantage of the jacket/coat in accordance with the present invention is that it provides ventilation without compromising protection from the environmental elements.

Figure 1:
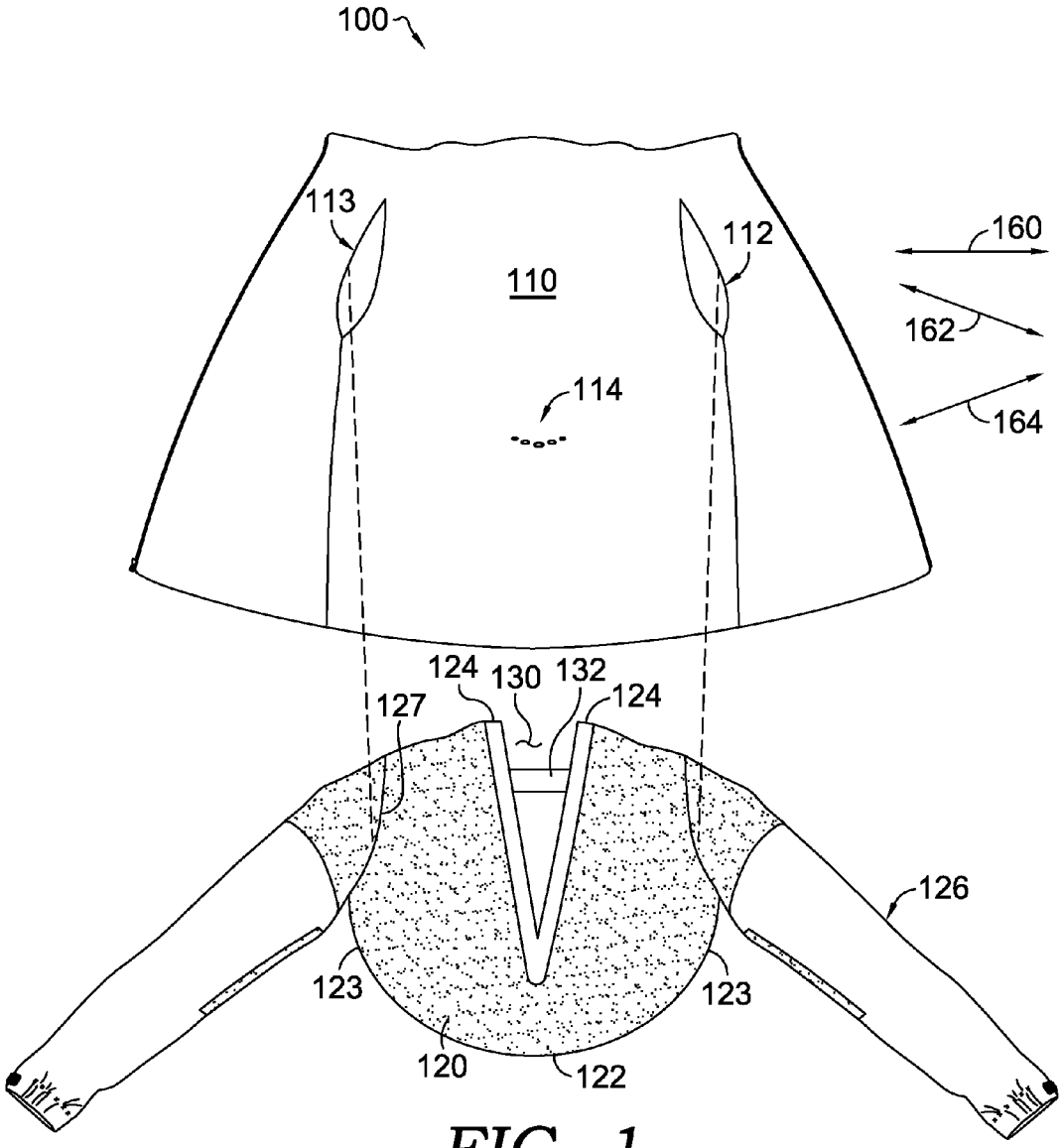
FIG. 1 is a deconstructed view of an exemplary jacket/coat in accordance with the present invention.

Referring to FIG. 1, a deconstructed jacket/coat 100 in accordance with the present invention is shown. As shown in FIG. 1, the jacket/coat 100 comprises two main components, a partial shrug-like portion (only covering the back) 120 comprising the sleeves 126, and a vest portion 110 comprising the full length of the jacket/coat 100.

Figure 14:
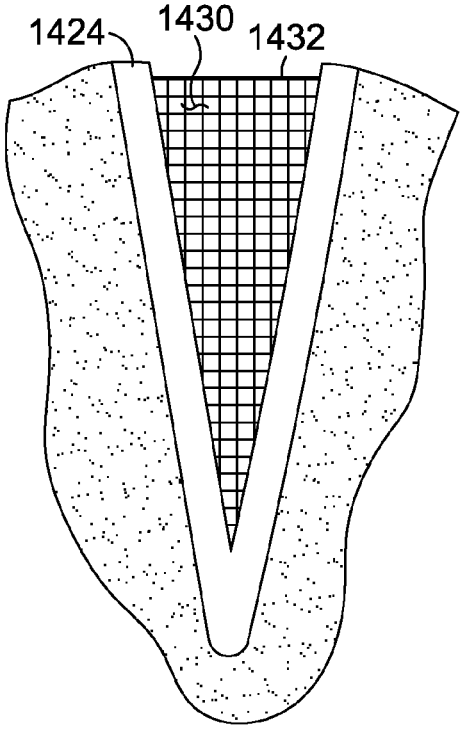
FIGS. 14 and 15 illustrate examples of alternative strain-relieving cutouts for jackets/coats in accordance with the present invention.
Figure 15:
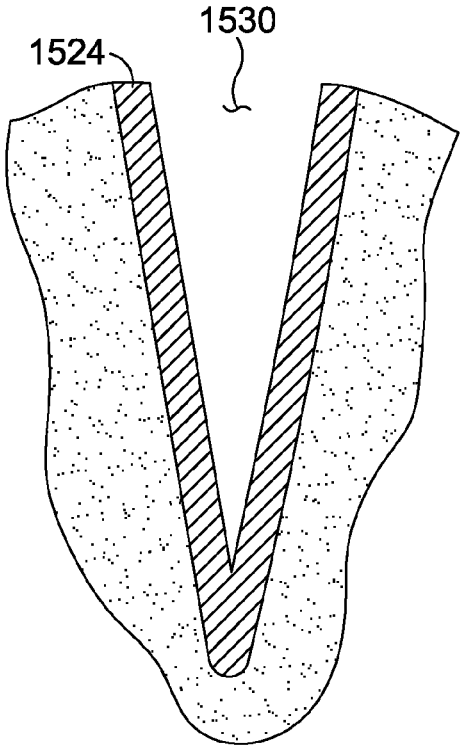

The partial shrug-like portion 120 may comprise a more elastic material than the vest portion 110. Further, the partial shrug-like portion 120 may comprise a strain-relieving cutout 130 extending, for example approximately 0.5 to 5 inches above the lower rounded edge 122 of the partial shrug-like portion 120, up to and including the collar edge 124 of the partial shrug-like portion 120. The strain-relieving cutout 130, may be stabilized by an elastic stabilizer 132 located approximately 0.5 to 5 inches below the cutout collar edge 124, where the collar seam would have been. The strain-relieving cutout 130 may be shaped like a "V" as shown, or any other shape suitable for its intended purpose. Elastic stabilizer 132 may be omitted or replaced, for example with a mesh. Examples of some alternative strain-relieving cutouts are depicted in FIGS. 14 and 15. FIG. 14 shows a V-shaped strain-relieving cutout 1430 with an edge 1424 stabilized with a mesh insert 1432, which may be stretchable. FIG. 15 shows a V-shaped strain-relieving cutout 1530 with a reinforced edge 1524 that maintains its form during use. Reinforced edge 1524 may be formed using layering, laminants, plastic inserts, metal inserts, seam tape, elastomers, etc. While the examples of strain-relieving cutouts suitable for use in a jacket/coat in accordance with the present invention have been illustrated with a V-shape, other shapes, such as a U-shape, may be used.

The sleeves 126 of the jacket/coat in accordance with the present invention may optionally be an integral and continuous part of the partial shrug-like portion 120. The sleeves 126 may comprise the same elastic material as the partial shrug-like portion, at least up to the region of the sleeves 126 covering the upper arm above the elbow, and the elbow region 125 (as shown). In a different example, the sleeves 126 may comprise the same elastic material as the partial shrug-like portion all the way to the wrist potion. In yet a different example of the present invention, the sleeves 126 may be convertible between a short sleeve and a long sleeve, for example by having a zipper with a zipper flap covering the zipper, dividing the sleeves 126, just above the elbow, into an upper sleeve and lower sleeve. The zipper may be used to attach or detach the lower-sleeve portion from the upper-sleeve portion of the jacket/coat 100, at the convenience of the user.

Moving on to the construction of the jacket/coat 100 in accordance with the present invention, the vest portion 110 comprising the full-length of the jacket/coat 100, may be placed over and attached to the partial shrug-like portion 120 at the bottom rounded edge 122, and side edges 123 of the partial shrug-like portion 120. Only the front edge 127 of the sleeves 126 may be attached to the front side edge 113 of the armhole 112 in the vest portion 110. In other words, there may be no seams on the back and shoulders of the jacket/coat 100 in accordance with the present invention. Therefore, since essentially, a "pocket" (accessible at the shoulders from the back) is formed between the partial shrug-like portion 120 and the vest portion 110, perforations 114 are provided on the vest portion 110 slightly above the seam with the bottom rounded edge 122 of the partial shrug-like portion 120. The perforations 114 may serve as a water-draining mechanism in case water slips into the "pocket" in the event that the jacket/coat is worn during rainy weather.

Figure 4:
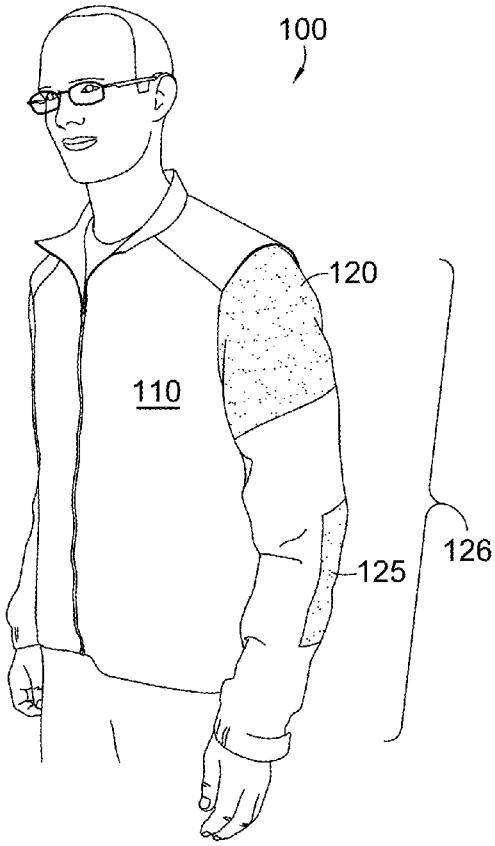
FIGS. 4-6 are different views of the exemplary jacket/coat shown in FIG. 1 as worn by an individual.
Figure 5:
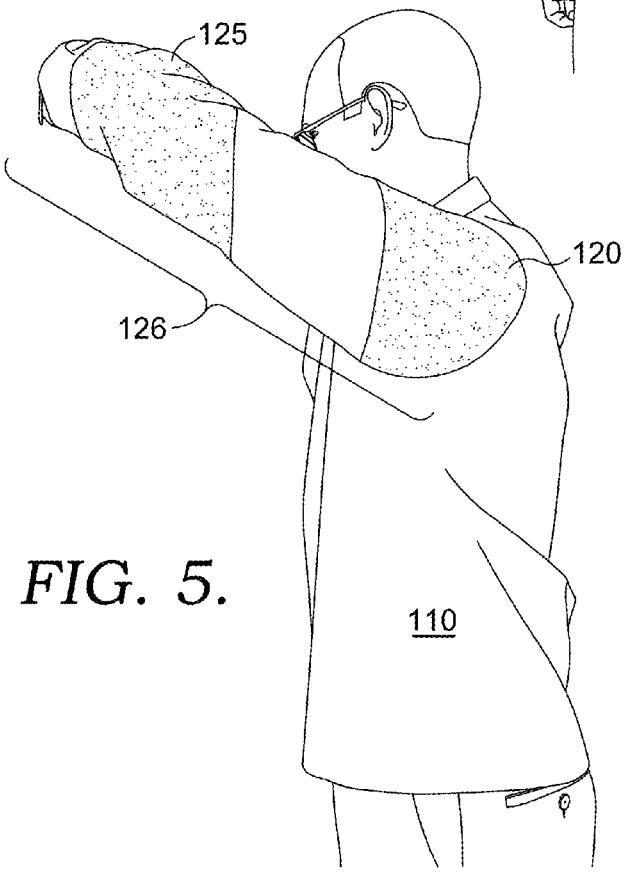
Figure 6:
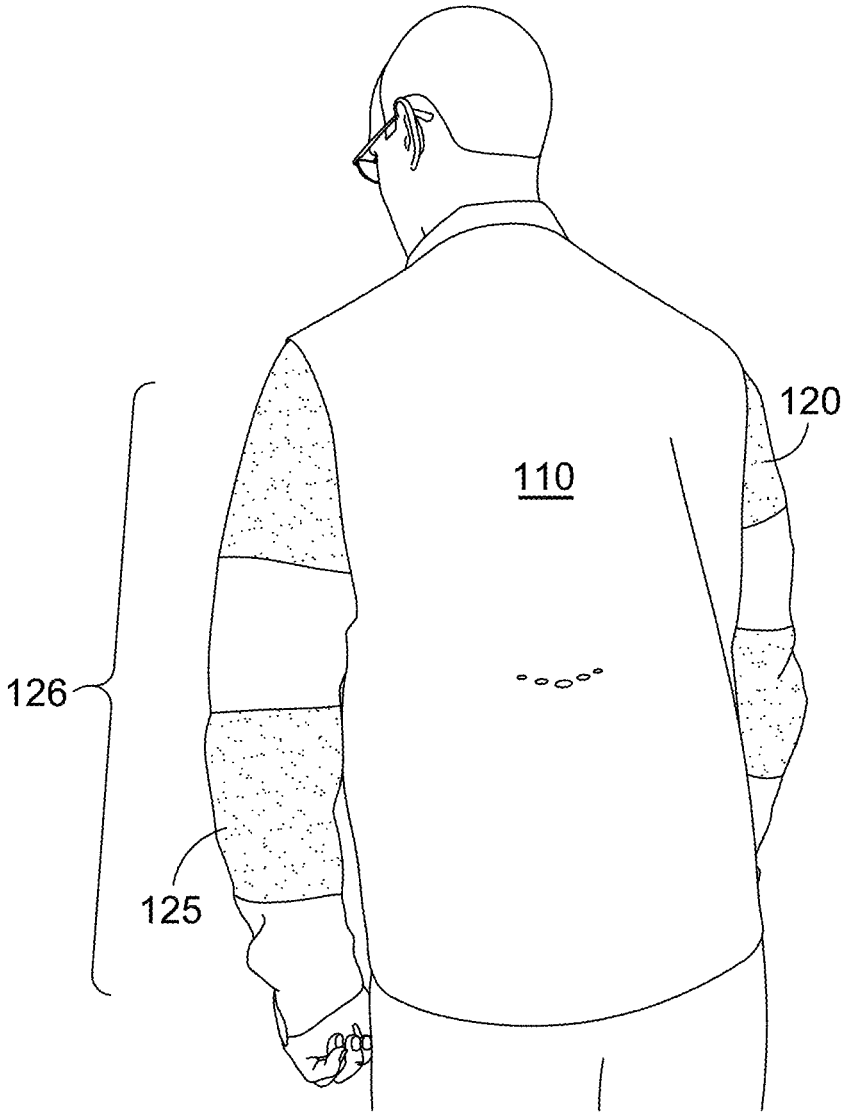

The jacket/coat 100 in accordance with the present invention may be made from a combination of water-resistant fabrics that may have additional differing properties such as added elasticity. Elasticity in such a fabric may be substantially multi-directional or may be operative only in some directions. For example, one or more materials used in constructing a garment in accordance with the present invention may comprise a four-way stretch textile, a two-way stretch textile, or other materials with desired properties. Textiles used may provide desired stretch properties, such as knits providing a degree of mechanical stretch. For example, as shown in FIGS. 4, 5, and 6, the sleeves 126 may comprise different materials with differing elasticity, where elbow portions 125 of the sleeves 126, which are configured to align with elbows of a wearer when the jacket is worn, have a higher elasticity than the rest of the sleeves 126. If a textile with predominantly two-way stretch along a single axis is chosen, that axis may be oriented substantially horizontally when the jacket is worn, as indicated at 160, or at any bias to horizontal, as indicated at 162 and 164. Optionally, different textile portions used in constructing a jacket in accordance with the present invention may have different stretch properties and/or different orientations. Further, the fabrics may comprise an elastomer water-proofing coating material, optionally with at least the same elastic characteristics as the fabrics themselves. The different seams for constructing the jacket/coat 100 in accordance with the present invention may be formed by stitching, welding (using adhesive materials), or a combination of both.

Figure 2:
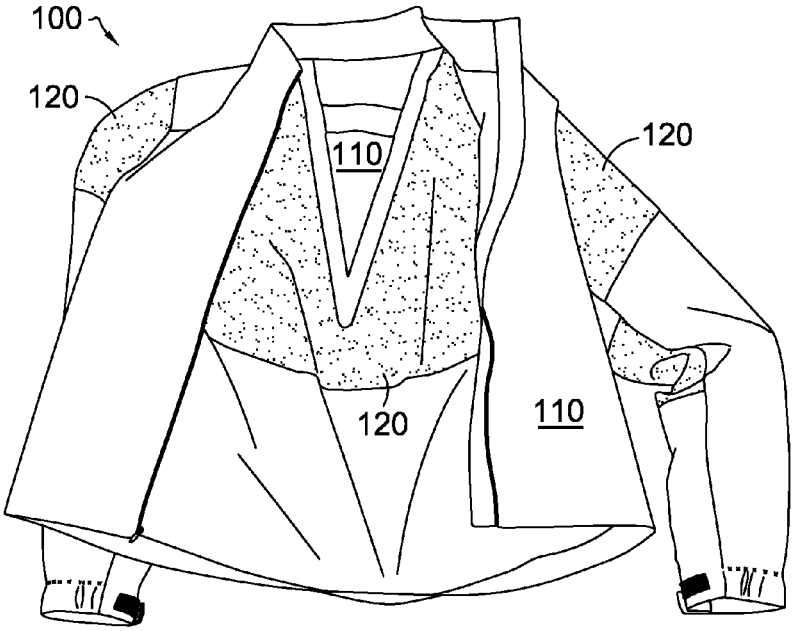
FIG. 2 is a layered front view of the exemplary jacket/coat shown in FIG. 1.
Figure 3:
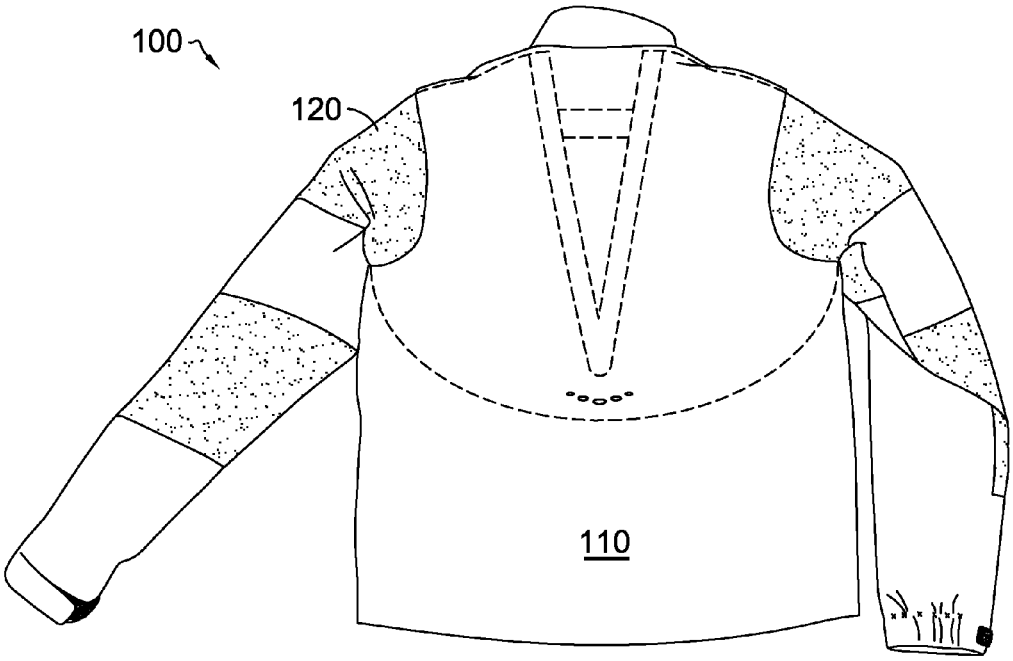
FIG. 3 is a layered back view of the exemplary jacket/coat shown in FIG. 1.

FIGS. 2 and 3 show front and back views, respectively, of the constructed jacket/coat 100 in accordance with the present invention. FIG. 3, in particular, shows how the partial shrug-like portion 120 and the vest portion 110 align with each other in the jacket/coat in accordance with the present invention. Further, FIGS. 4-6 show the jacket/coat 100 in accordance with the present invention as worn by a user. As observed from FIGS. 4-6, the jacket/coat 100 in accordance with the present invention provides an enhanced range of motion for the arms and back of a user by providing an elastic partial shrug-like portion 120 with a strain-relieving cutout 130 and, and by eliminating the shoulder and sleeve seams. Therefore, the jacket/coat construction in accordance with the present invention, may allow the back of the garment to expand and contract as needed with any type of movement by the user.

Since the vest portion 110 of the jacket/coat in accordance with the present invention determines the length of the jacket/coat, the vest portion may have any length desired for the particular style of jacket/coat desired. For example, the vest portion 110 may have any desired length, for example waist-length, hip-length, thigh-length, or any other length in between, or longer.

Figure 7:
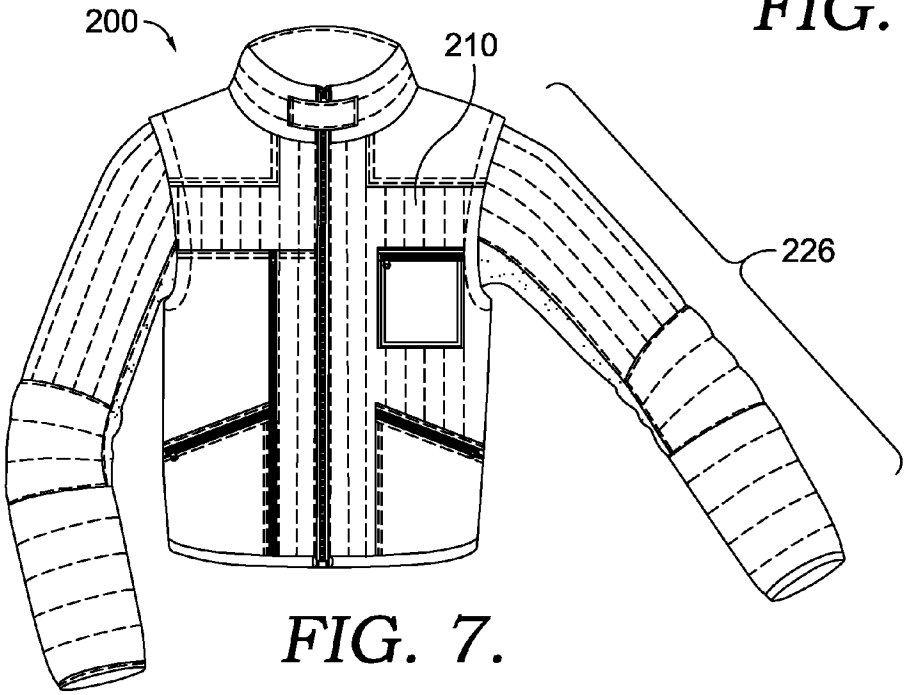
FIG. 7 is a front view of a different constructed exemplary jacket/coat in accordance with the present invention.

In reference to FIG. 7, another example jacket/coat 200 in accordance with the present invention is shown. As shown in FIG. 7, the jacket/coat 200 may have a vest portion 210 over a vest shrug-like portion 220 (not shown), with the sleeves 226 attached to it. The jacket/coat 200 may be thinly quilted with thermal fibers (synthetic or down), to provide some insulation in cold weather. Further, the outer shell of the jacket/coat 200 may be constructed from water-resistant or water-proof fabrics in combination with elastic fabrics that may or may not be waterproof.

Figure 8A:
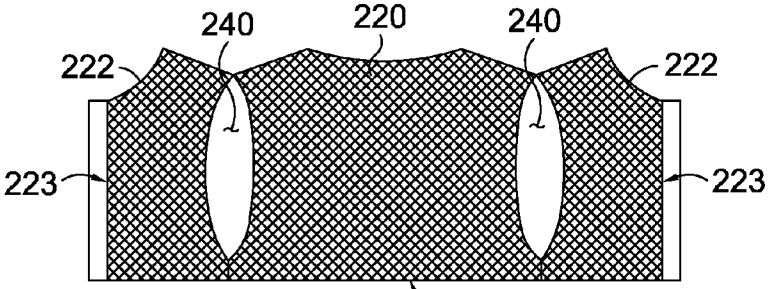
FIGS. 8A and 8B are deconstructed views of exemplary jacket/coat in FIG. 7.
Figure 8B:
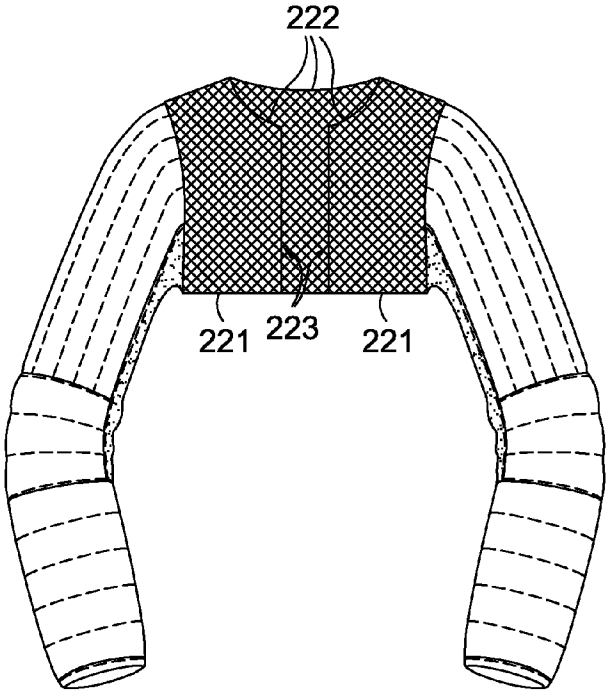

The vest shrug-like portion 220 is shown in FIG. 8A. The vest shrug-like portion 220 may comprise a resilient, yet flexible mesh-type material. The vest shrug-like portion 220 has two armholes 240 where the sleeves 226 are attached. Further, the vest shrug-like portion 220 comprises a bottom edge 221, collar edges 222, and two front edges 223, which represent the points of connection with the outer vest portion 210 when the jacket/coat 200 is constructed. In FIG. 8B, the vest shrug-like portion 220 with sleeves 226 attached is shown. As it can be clearly seen in FIG. 8B, the sleeves 226 have the same thinly quilted construction as the vest portion 210 and thus provide the same level of insulation as the vest portion 210. Further, the sleeves 226 may comprise a flexible and stretchable fabric material under the arm extending to the elbow region to provide enhanced flexibility in this region, especially when lifting the arms and bending the elbows.

Figure 10:
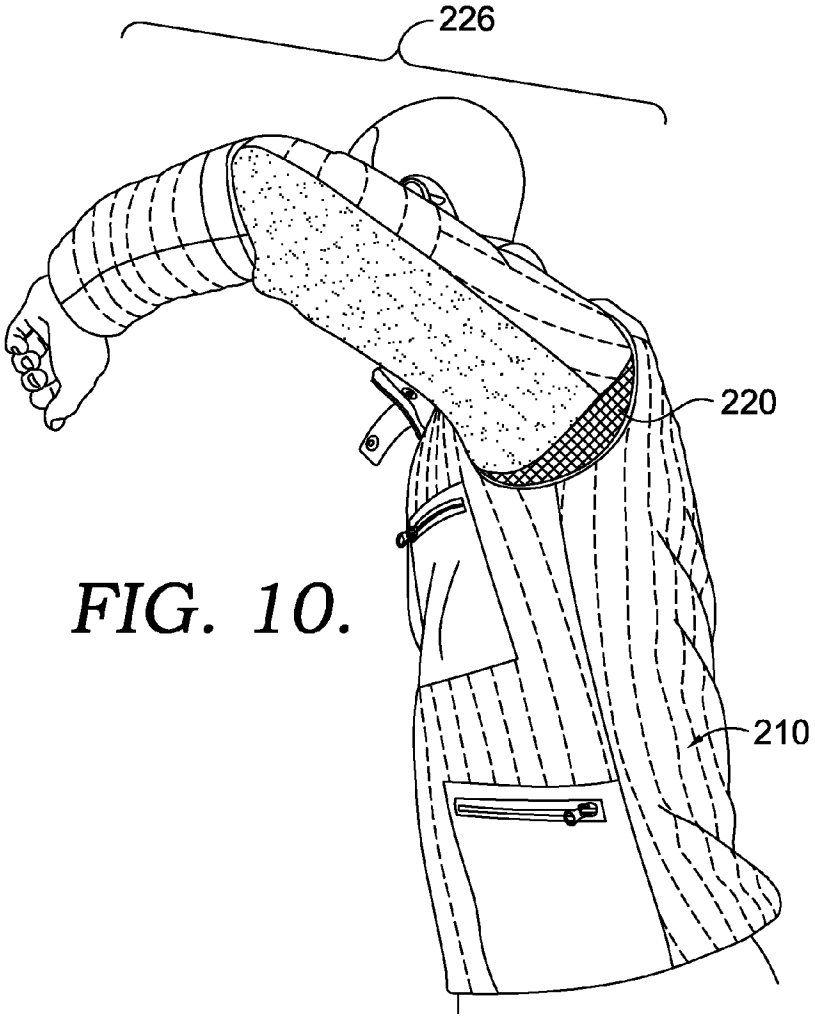
FIGS. 9 and 10 are different views of the exemplary jacket/coat shown in FIG. 7, as worn by an individual.
Figure 9:
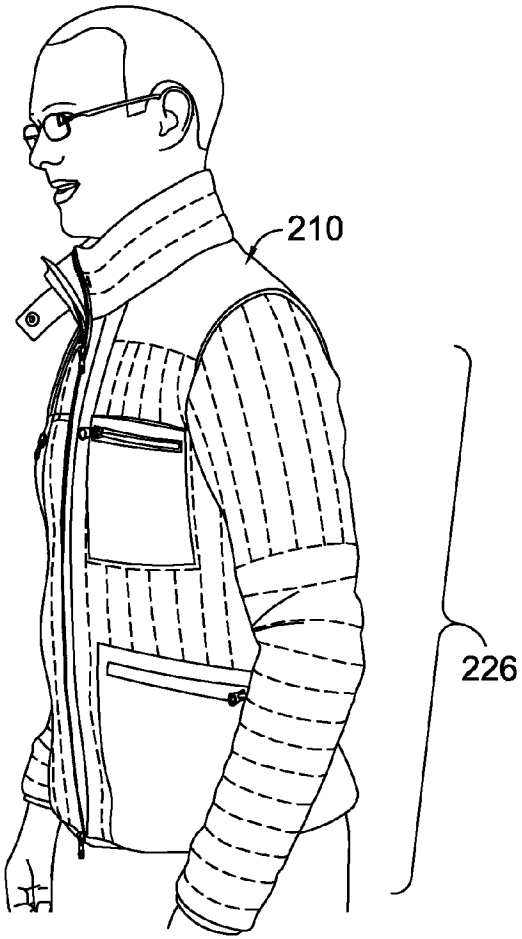

Additionally, as it can be seen in FIGS. 9 and 10, when a user is wearing the jacket/coat 200 in accordance with the present invention, the jacket/coat 200 not only protects the wearer from cold weather, but it does not impede the range of motion for the user because there are no seams at the sleeves and shoulders between the vest shrug-like portion 220 and the vest portion 210. Also, because of the flexible mesh construction of the vest shrug-like portion 220, temperature regulation is enhanced due to the possible airflow between the inside and the outside of the jacket/coat 200.

As the jacket/coat 100 presented in FIG. 1, the length of the jacket/coat 200 in FIG. 7 is determined by the length of the vest portion 210. Thus, the vest portion 210 may be of any length desired for the particular style or need for the jacket. For example, the vest portion 210 may be waist-length, hip-length, thigh-length, knee-length, or any other length in between, or longer.

Figure 11:
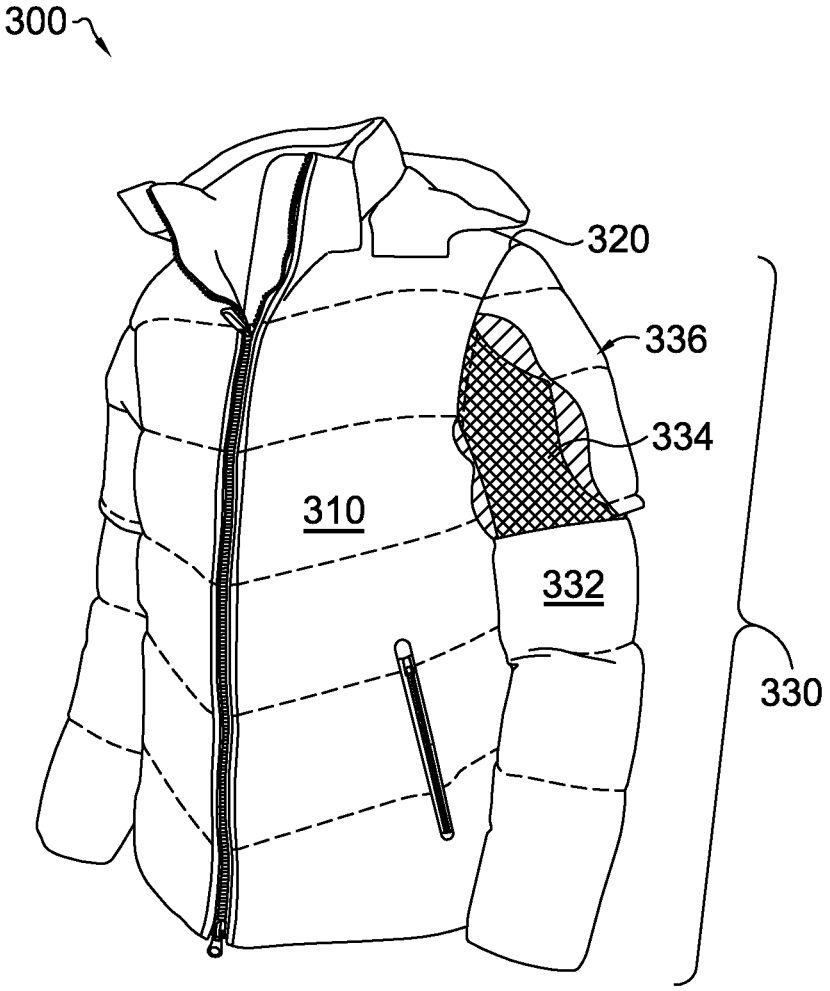
FIG. 11 is a view of a different jacket/coat in accordance with the present invention showing the construction of the sleeve comprising a lower sleeve and an upper sleeve.
Figure 13:
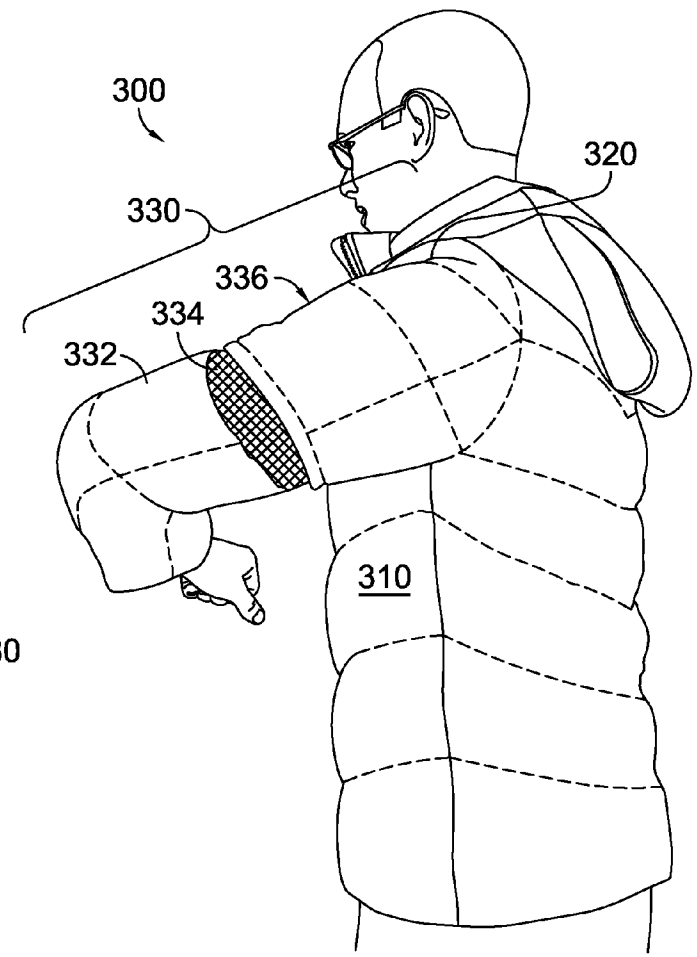
FIGS. 12 and 13 are different views of the exemplary jacket/coat shown in FIG. 11, as worn by an individual.
Figure 12:
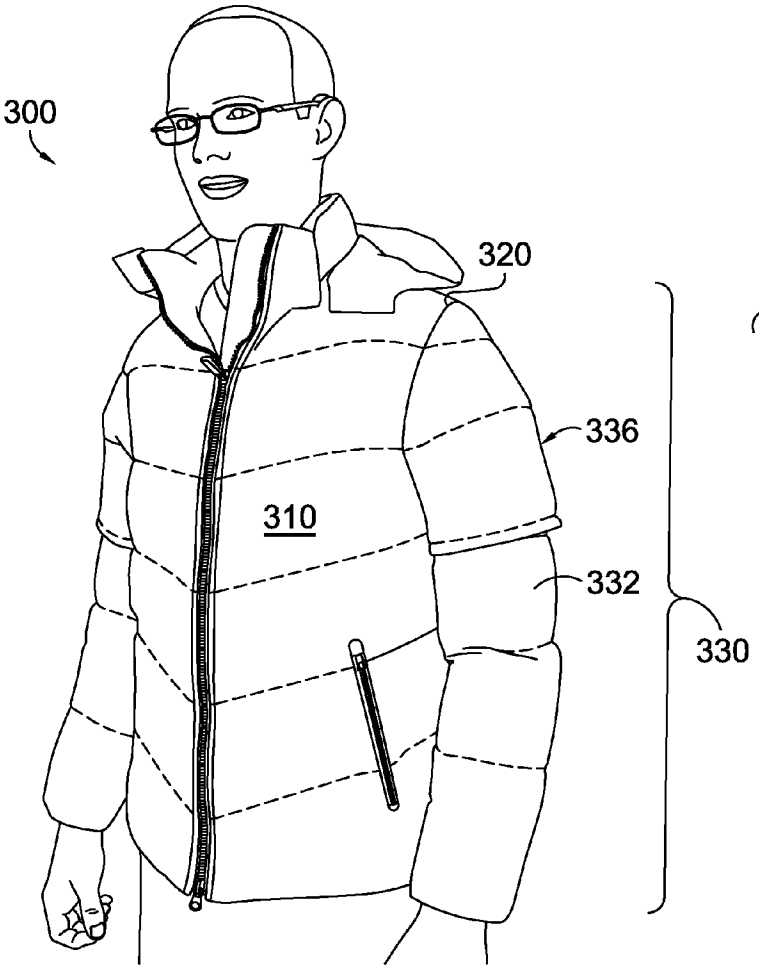

In yet a further example of the jacket/coat in accordance with the present invention, a thick winter jacket/coat 300 is shown in FIGS. 11-13. Since winter jackets tend to be bulky for insulating against cold weather, inevitably, they may have limited breathability and may be restrictive and not allow a user full range of motion for his/her arms and shoulders. Therefore, in the jacket/coat 300 in accordance with the present invention, an insulated body portion 310 configured to cover a trunk body portion of a wearer, and a pair of composite sleeves 330 are provided, where the pair of composite sleeves 330 are configured to provide breathability and enhanced range of motion without compromising insulation from cold weather. In other words, the sleeves 330 may comprise three different sections: a lower sleeve 332, an upper sleeve 334 and a cover sleeve 336. The lower sleeve 332 may be constructed in the same way as the rest of the jacket/coat 300 using the same materials, including the insulating fibers, and may cover an arm from the wrist up to and including the elbow. Then, the upper sleeve 334, comprising a flexible and resilient mesh-type material, may be attached to the lower sleeve 332 by a seam above the elbow, and may cover the arm up to the shoulder, and be attached to the jacket/coat 300 at the seam around the armhole 320.

Finally, the cover sleeve 336 may also be constructed from the same materials as the rest of the jacket/coat 300, including the insulating fibers. The cover sleeve 336 may be attached to the rest of the jacket/coat 300 by a seam 320 connecting it to the armhole of the jacket/coat 300. The cover sleeve 336 may extend from the shoulder to slightly below the upper sleeve 334, completely concealing the upper sleeve 334 when the arm of a user is in a rest position parallel to the user's body. It may be noted that the length ratios of the upper sleeve 334 and lower sleeve 332 may be other than the one described above. Also, the length of the cover sleeve 336 may also change accordingly, to conceal the upper sleeve 334.

FIG. 12 shows the jacket/coat 300 as worn by a person with his arms in a rest position. As it can be observed, the upper sleeve 334 of the sleeve 330 is completely concealed by the cover sleeve 336. FIG. 13 shows how the mesh-type material comprising the upper sleeve 334 may stretch when the wearer bends his/her arms, therefore relieving strain on the garment.

The jacket/coat 300 with the composite sleeves 330 in accordance with the present invention, may allow for improved airflow between the inside and outside of the jacket/coat 300 and enhanced flexibility for a user due to the flexibility provided by the mesh material comprising the upper sleeve 334, keeping the user more comfortable. In other words, the composite sleeve construction in accordance with the present invention may provide enhanced temperature regulation, as well as an enhanced range of motion for the user.

Further, just like the jackets presented above, the jacket/coat 300 in accordance with the present invention may be of different lengths according to the style and coverage desired. For example, the jacket/coat 300 may be waist-length, hip-length, thigh-length, knee-length, or any other length in between, or longer.

From the foregoing, it will be seen that this invention is one well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many different jacket/coat styles may be made of the invention without departing from the scope thereof, it is to be understood that all matter herein set forth or shown in the accompanying drawings is to be interpreted as illustrative and not in a limiting sense.

Having thus described the invention, what is claimed is:

1. A jacket/coat comprising:

a partial shrug component having a back portion, a first sleeve having a first front edge and a second sleeve having a second front edge, the first sleeve and the second sleeve extending from the back portion, wherein the back portion of the partial shrug component comprises a V-shaped strain relieving cutout that extends from 1 to 5 inches above the bottom edge of the back portion of the partial shrug component up to and including a collar edge of the back portion of the partial shrug component; and a vest component positioned over the partial shrug component, the vest component having a back portion, at least one front portion, a first armhole , and a second armhole;

wherein the first armhole and the second armhole each comprise a front edge corresponding to the at least one front portion of the vest component, and a back edge corresponding to the back portion of the vest component;

wherein the first sleeve of the partial shrug component extends through the first armhole of the vest component and the second sleeve of the partial shrug component extends through the second armhole of the vest component;

wherein the front edge of the first armhole corresponding to the at least one front portion of the vest component is aligned with and seamed to the first front edge of the first sleeve of the partial shrug component;

wherein the front edge of the second armhole corresponding to the at least one front portion of the vest component is aligned with and seamed to the second front edge of the second sleeve of the partial shrug component;

wherein the first sleeve and the second sleeve of the partial shrug component are fully detached from the back portion of the vest component; and wherein at least a portion of a bottom edge of the back portion of the partial shrug component is seamed to a central portion of the back portion of the vest component.

2. The jacket/coat as in claim 1, wherein the partial shrug component comprises an elastic fabric, and the vest component comprises a non-elastic fabric.

3. The jacket/coat as in claim 1, wherein the strain-relieving cutout further comprises an elastic stabilizer 1-5 inches below the collar edge of the back portion of the partial shrug component.

4. The jacket/coat as in claim 1, wherein the first and second sleeves of the partial shrug component are continuous with the back portion of the partial shrug component at least up to a region of the first and second sleeves configured to align with upper arm portions of a wearer, when the jacket/coat is worn.

5. The jacket/coat as in claim 4, wherein the first and second sleeves of the partial shrug component further comprise the elastic fabric of the partial shrug component at elbow portions of each of the first and second sleeves that are configured to align with elbows of a wearer when the jacket/coat is worn.

6. The jacket/coat as in claim 1, wherein the back portion of the vest component comprises at least one perforation.

7. The jacket/coat as in claim 1, wherein the back portion of the vest component comprises at least one perforation located above the seam attaching at least the portion of the bottom edge of the back portion of the partial shrug component to the central portion of the back portion of the vest component.

8. The jacket/coat as in claim 7, wherein the bottom edge of the back portion of the partial shrug component is angled.

9. The jacket/coat as in claim 1, wherein a first distance extending from a collar of the jacket/coat to a bottom edge of the back portion of the vest component is greater than a second distance extending from the collar of the jacket/coat to the bottom edge of the back portion of the partial shrug component.

* * * * *